US005509881A

United States Patent [19]

Sharples

[11] Patent Number: 5,509,881

[45] Date of Patent: Apr. 23, 1996

[54] CENTRIFUGE ROTOR IDENTIFICATION AND REFRIGERATION CONTROL SYSTEM BASED ON WINDAGE

[75] Inventor: Thomas D. Sharples, Atherton, Calif.

[73] Assignee: Beckman Instruments, Inc., Fullerton, Calif.

[21] Appl. No.: 271,836

[22] Filed: Jul. 7, 1994

[51] Int. Cl.[6] ..... B04B 13/00

[52] U.S. Cl. ..... 494/7; 494/10; 494/14; 494/37

[58] Field of Search ..... 494/1, 7, 8, 9, 494/10, 11, 12, 13, 14, 16, 37, 61, 84; 422/72, 105, 108; 436/45; 210/145, 739, 774, 787, 808

[56] References Cited

U.S. PATENT DOCUMENTS

| | | | |
|---|---|---|---|
| 3,409,212 | 11/1968 | Durland et al. | 494/16 X |
| 4,449,965 | 5/1984 | Strain | 494/16 |
| 4,451,248 | 5/1984 | Williams | 494/84 |
| 4,509,940 | 4/1985 | Romanauskas | 494/16 |
| 4,551,715 | 11/1985 | Durbin | 340/671 |
| 4,693,702 | 9/1987 | Carson et al. | 494/84 X |
| 4,700,117 | 10/1987 | Giebeler et al. | 318/327 |
| 4,827,197 | 5/1989 | Giebeler | 318/3 |
| 4,857,811 | 8/1989 | Barrett et al. | 494/10 X |
| 5,221,250 | 6/1993 | Cheng | 494/7 |
| 5,235,864 | 8/1993 | Rosselli et al. . | |

FOREIGN PATENT DOCUMENTS

| | | | |
|---|---|---|---|
| 3632087 | 7/1987 | Germany | 494/10 |

*Primary Examiner*—Charles E. Cooley
*Attorney, Agent, or Firm*—William H. May; Gary T. Hampson; Schneck & McHugh

[57] ABSTRACT

A method and system of identifying a rotor of a centrifuge employ an approach that uses two tiers of model selection. Firstly, the moment of inertia of a rotor is calculated for a first measured acceleration. The indication of moment of inertia is utilized to disqualify a number of rotor models and to select a subset of models. In a second tier, windage power of the rotor is calculated in a manner that isolates windage from inertial drag. In one embodiment, drive torque is measured with the rotor operated at a high constant speed. Alternatively, windage is calculated using data obtained during a second measured acceleration. The accuracy of the computation is enhanced by taking into account the moment of inertia as one form of resistance to the second acceleration. Based upon the indication of windage power, at least one rotor model within the subset is disqualified. Upon identification of the rotor, the centrifugal process can be maintained at a maximum safe speed. Moreover, a refrigeration offset circuit is controlled to provide a dynamic temperature correction with changes in windage power.

17 Claims, 5 Drawing Sheets

CENTRIFUGE ROTOR IDENTIFICATION AND REFRIGERATION CONTROL SYSTEM BASED ON WINDAGE

TECHNICAL FIELD

The present invention relates generally to centrifuges used in biochemistry, medicine and other branches of science and engineering and more particularly to rotor differentiation and rotor temperature control.

BACKGROUND ART

Essentially, a centrifuge is a device for separating particles suspended in a sample solution. A centrifuge rotor that contains the sample solution is driven at high rotational speeds inside an enclosed chamber. Typically, the chamber contains air at atmospheric pressure, but it is not uncommon to operate a centrifuge system at less than atmospheric pressure. The reduction in pressure decreases windage power consumption. In an extreme instance, ultracentrifuges are operated at high vacuums to reduce frictional heating of the rotor. Typically, high speed laboratory centrifuges are operated in a range having a high end of 1 atmosphere and a low end of 0.5 atmosphere, but in special applications gases such as helium, nitrogen and argon may be substituted for air and the high end of the range may exceed 1 atmosphere.

A centrifuge rotor is heated to a minor extent by thermal conduction from a drive motor, through a drive shaft. However, in instances other than use of the ultracentrifuge, heating of a high speed rotor occurs primarily by thermal conduction from the air or other gas within the chamber, with the gas being heated by the work done on the gas by the rotor. This work takes the form of accelerating the gas and inducing a pumping action that then leads to rapid recirculation of the gas and a buildup of heat. It is known to provide such centrifuges with refrigeration systems designed to extract heat from the chamber in order to maintain the rotor at a desired temperature.

One of the problems encountered in the design of high speed laboratory centrifuges relates to the requirement that the centrifuge be operable with numerous interchangeable rotors. In some circumstances, there are as many as twenty different interchangeable rotors for a general-purpose, high speed laboratory centrifuge. Rotor models are made in a range of sizes and have numerous variations in design. Each rotor model has a rated maximum safe rotational speed, which generally depends on maximum allowable centrifugally induced stresses. The rated maximum safe speeds cover a large range. To accommodate the speed requirements, a centrifuge drive system is provided with a wide range of adjustability. However, the various rotors will differ considerably in the windage power consumed when the rotors are spun at the maximum speed. It follows that the refrigeration power required to neutralize the heating of the air in the chamber will depend on the specific rotor and on the speed at which the rotor is operated. In prior art designs that include refrigeration systems, the temperature of the enclosed chamber is typically monitored. For example, the air flowing slightly above the bottom of the chamber may be temperature monitored. More or less satisfactory control has been obtained by experimentally determining the optimal refrigeration settings for the individual rotors over a range of speeds. Thus, it is necessary to select settings designed for a desired rotor and, additionally, provide special offsets for some rotors depending upon exact calibration of the rotor versus refrigeration settings.

The reasons for the difficulty of determining and setting the refrigeration controls derive from the physical laws associated with the aerodynamics of rotating bodies. The equation describing windage power sets forth the power losses as being proportional to the cube of the rotational speed and to the fifth power of the diameter of the rotating body when the rotating body is in a relatively close fitting and smooth chamber. As the chamber walls are moved proportionally further from the rotating body, the windage losses increase considerably from that predicted by the simple equation. Thus, both for proper temperature control and for safety against rotor failure through accidental overspeed setting, the rotor must be correctly identified.

It has been customary to depend upon the operator to correctly identify the rotor and adjust speed and refrigeration settings accordingly. More recently, there has been a growing concern and requirement for safety redundancy in rotor identification and, even in the instance of ultracentrifuges which have had at least one level of overspeed protection for years, an additional level has been introduced. In many instances, the secondary and tertiary identification need not be absolute, since it is sufficient to provide differentiation to the extent that no rotor is spun at a speed higher than its rated maximum safe speed. Several quite different rotors may have identical allowable speeds, and the only requirement is that the secondary and tertiary identification differentiate these rotors from all rotors that have a higher rated maximum safe speed.

Indicative of a redundant identification system is the apparatus described in U.S. Pat. No. 4,827,197 to Giebeler, which is assigned to the assignee of the present invention. Giebeler teaches that an identification of a rotor may be made by calculating the moment of inertia of the rotor. The rotor is accelerated under constant torque. Acceleration from a first speed to a second speed is timed and the moment of inertia is computed by using the calculations of change in speed and change in time. After obtaining the moment of inertia, Giebeler teaches that the identification can be made by matching the calculated moment of inertia to a known moment of inertia of one of a variety of different rotor models.

U.S. Pat. No. 5,235,864 to Rosselli et al. also teaches a redundant rotor identification system. However, instead of calculating moment of inertia, Rosselli et al. teaches measuring "windage," which is defined in the patent as being the resistance to rotor motion that is a result of fluid frictional effect. It is taught that "windage" is determined by either measuring the time needed to accelerate the rotor from a first relatively high speed to a second higher speed or measuring the change in speed that takes place within a preselected period of time. The resulting velocity signal or time signal generated during this step is then used to generate a rotor identity signal by means of either comparing the signal with a reference signal indicative of a reference "windage" value or by means of addressing a look-up table of "windage" values. It is taught that, in one embodiment, a preliminary decision is made as to whether the rotor lies in the high windage regime or the low windage regime of rotors. However, it is left unclear as to how the decision is to be based. In any embodiment, the determination of windage is achieved by accelerating the rotor at relatively high speeds at which Rosselli et al. teaches that windage becomes dominant to inertia in resisting acceleration of the motor.

One difficulty with the approach described in Rosselli et al. is that the generated velocity signal or time signal used to identify the rotor is responsive to both a windage component of rotor resistance and an inertia component. That is, the acceleration does not isolate components of resistance to rotor acceleration. Rosselli et al. teaches that the acceleration is to occur for speeds at which the windage component is dominant to the inertial component. However, the inertial component is present for any acceleration. Another concern with the approach of Rosselli et al. is that "windage" is defined as merely the resistance to motion resulting from a fluid frictional effect. As defined herein, "windage" is primarily the power consumed in pumping the gaseous atmosphere within the enclosed chamber of the centrifuge when the rotor is spun at high rotational speeds. At these high speeds, viscous frictional drag plays the role of providing mechanical coupling of the rotor to the mass of gas, resulting in the gas pumping. However, distinguishing viscous frictional drag and power consumed in pumping the gaseous atmosphere is important.

It is an object of the present invention to provide a method and system for assuring that any rotor from a family of rotors operable within a centrifuge will not be driven beyond a maximum safe operating speed for the rotor. A further object is to provide rotor operating information to a refrigeration control system, wherein the information is specific to the identified rotor.

SUMMARY OF THE INVENTION

The above objects have been met by a method and system which isolate inertial drag in a measurement of windage that is used first to identify a centrifuge rotor and secondly to control a refrigeration system. In one embodiment, a first sorting of possible rotor models is performed by measuring inertia under conditions in which there is a zero or minimum windage component and a second sorting is performed by measuring windage independent of rotor inertia. Based upon the two-step sorting process, operation of a centrifuge is controlled to prevent over-speed and/or to regulate temperature.

In the first step of sorting, a calculation of moment of inertia may include a first measured acceleration of a rotor to be identified. Either a time period of acceleration or an incremental increase in rotational speed should be fixed, while the other factor is measured. It is the time period that is typically fixed, with the change in rotational speed being the measured variable. Preferably, the torque provided by a drive motor during the measured acceleration is constant, thereby simplifying the calculation of the moment of inertia. However, this is not critical. Since the moment of inertia can be calculated by dividing the change in rotational speed into the product of the torque times the time period required to achieve the change in speed, an indication of the moment of inertia is obtainable. The calculation of the moment of inertia of the rotor itself will not be a conclusive one if the step includes accelerating an unspecified quantity of sample solution contained within the rotor. Nevertheless, a subset of rotor models can be identified based upon the indication, thereby disqualifying some of the models to which the rotor can be identified.

Following the sorting utilizing inertia, the rotor of interest is accelerated to a speed which permits a reliable measurement of power required to pump the gas, typically air, within a centrifuge chamber that houses the rotor. In one embodiment, this air pumping power, i.e. "windage," is measured using information obtained by feedback from the electrical drive system of the centrifuge. Preferably, the drive motor is a switched reluctance motor. The switched reluctance drive provides the desired information regarding torque input. At a high constant speed, the torque input, adjusted for known motor losses, is substantially equal to windage power, since the inertial drag of the rotor is zero.

In another embodiment, the computation of windage is based upon a second measured acceleration. Again, either the time period or the incremental increase in rotational speed may be preselected, with the other factor being measured. Typically, it is the time period that is fixed. Windage power is then calculated to be the difference between torque input ($\tau$) and the product of the moment of inertia (I) times the change in rotational speed ($\Delta\omega$) divided by the change in time ($\Delta t$), i.e., windage$=\tau-I\ (\Delta\omega/\Delta t)$. Stated differently, windage torque is equal to the difference between motor input torque and inertial torque.

The calculation of windage power is then employed to select those rotor models of the subset of models having properties which are characteristic of the measured windage power. Ideally, this step disqualifies all but one rotor model. On the other hand, if more than one possibility of rotor models remains, the calculation of windage may be repeated at some higher constant rotational speed or some higher measured acceleration. The increase in speed should still be below the lowest rated maximum velocity of the possible models to which the rotor in question can be identified. In most instances, the calculation of windage can be repeated at increasingly higher speeds until all but one rotor model has been disqualified.

Once the rotor has been identified, the operation of centrifugal separation can be carried out at the known rated maximum safe speed of the rotor. Additionally, the computation of windage can be utilized to affect other run parameters. Most notably, adjustments are made to operation of the refrigeration system based upon changes in windage. For centrifuges operating in a windage regime, rotor heating is due primarily to windage power. The work performed by the rotor in pumping air within the centrifuge chamber heats the air, which then heats the rotor. Unlike operation of an ultracentrifuge, direct frictional heating is insignificant. Refrigeration can be adjusted continuously or periodically in response to changes in windage losses. This can be achieved by again monitoring input torque when the drive system is operated at a high, constant speed.

An advantage of the present invention is that a reliable rotor identification and refrigeration control system is provided. In the operation of centrifuges, the drive power required to achieve a set incremental increase in rotational speed will vary directly with the cube of the rotor speed. Thus, providing a temperature offset setting that can provide correction at speeds substantially different than a refrigeration system calibration speed is difficult. Furthermore, the windage power is exponentially increased with increases in the diameter of a rotor, so that establishing a universal offset adjustment is further complicated. Utilizing the present invention, the rotor can be identified and refrigeration can be dynamically adjusted to maintain a desired operating temperature.

BEST MODE FOR CARRYING OUT THE INVENTION

Figure 1:
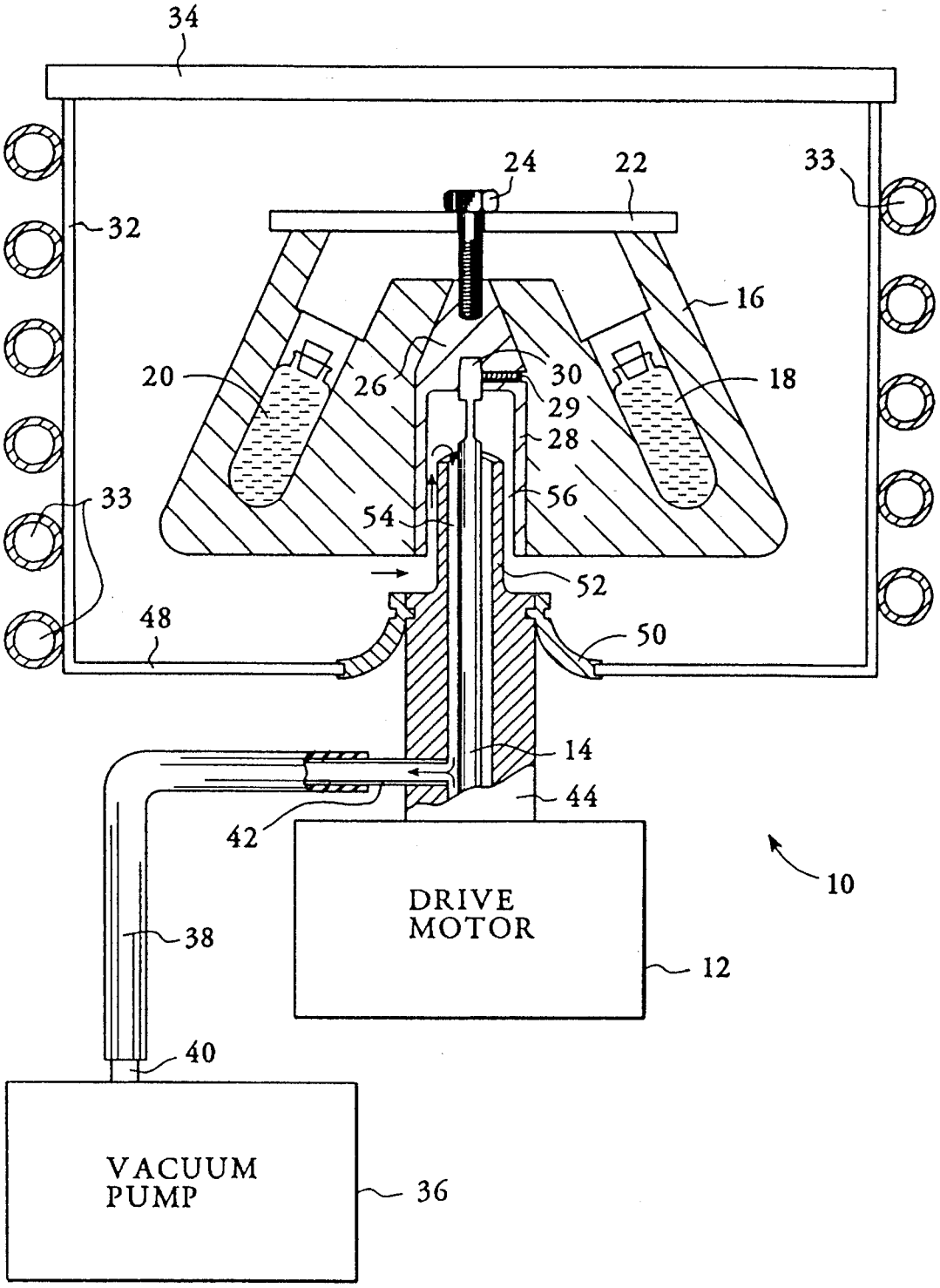
FIG. 1 is a side sectional view of a centrifuge for control in accordance with the present invention.

With reference to FIG. 1, a centrifuge 10 includes a drive motor 12 for rotating a drive shaft 14. Preferably, the drive motor is a switched reluctance motor. An advantage of such a motor is that a readout of torque generated by the motor is available at all times.

The rotor 16 is shown as having compartments for securing at least two specimen containers 18 and 20 for the centrifugal separation of specimen components. The containers 18 and 20 are placed in the rotor by removing a rotor lid 22. A bolt 24 extends through a hole in the rotor lid to secure the rotor lid 22 to the rotor 16 and secure the rotor to the hub.

Figure 2:
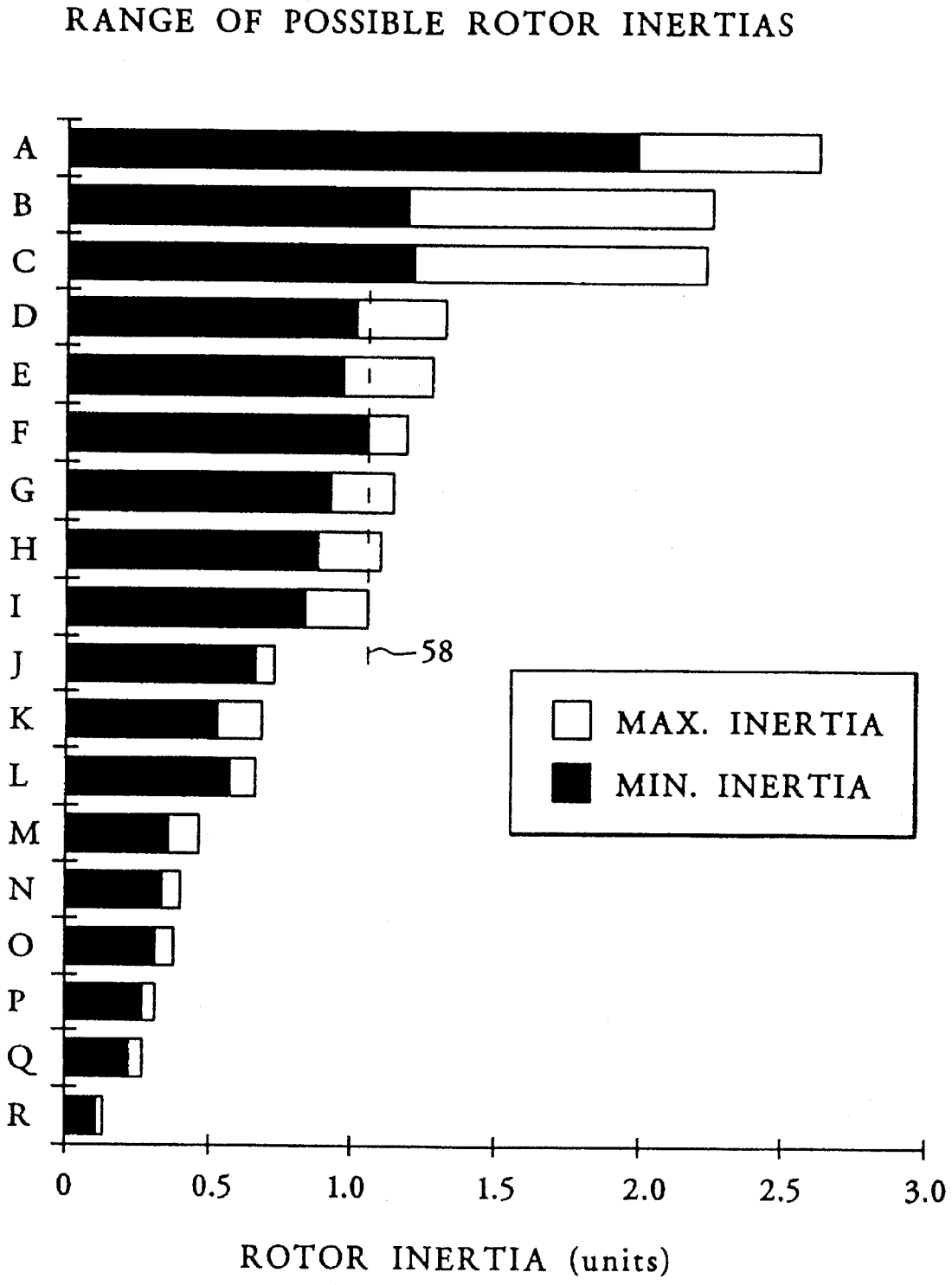
FIG. 2 (PRIOR ART)
FIG. 2 is a chart of available rotors to be connected to the centrifuge of FIG. 1.

The hub 26 is adapted for connection to any of a variety of rotor models. For example, FIG. 2 is a graph of eighteen rotor models available for use with centrifuges sold by Beckman Instruments, Inc. The rotor 16 of FIG. 1 may be any one of the eighteen rotors of FIG. 2.

The hub 26 has a cylindrical, downwardly depending skirt 28. The hub is fixed to the upper end of the drive shaft 14 by a set screw 29 such that the cylindrical skirt is coaxial to the drive shaft. The rotational drive of the motor 12 is transferred to the rotor 16 by means of the drive shaft 14 and the hub 26. The upper end 30 of the drive shaft may be secured to the hub using conventional techniques. The rotor has an internal surface configured to receive the hub 26.

The rotor 16, the hub 26 and the upper portion 30 of the drive shaft 14 are contained within a chamber defined by a housing 32 having a cover 34. While not shown, typically vacuum seals are located at the interface of the cover with the remainder of the housing. The side walls and the bottom wall of the housing 32 may be a metallic framework having refrigeration coils 33 at exterior surfaces to control the temperature within the enclosed chamber defined by the housing.

In addition to temperature control, the atmosphere within the enclosed chamber of the housing 32 may be controlled by operation of a vacuum pump 36. The vacuum pump is connected to a sleeve 44 by a conduit 38 and two fittings 40 and 42. The sleeve 44 has a lower, large diameter portion that extends coaxially with the drive shaft 14 to penetrate an opening in the bottom wall 48 of the housing 32. A vacuum seal 50 prevents leakage of air about the sleeve. At the upper end of the sleeve, a reduced diameter portion 52 extends into the downwardly depending skirt 28 of the hub 26. Thus, a first annular gap 54 is formed between the drive shaft 14 and the inner surface of the sleeve 44, and a second annular gap 56 is formed between the downwardly depending skirt 28 of the hub and the outside diameter of the portion 52 of the sleeve 44.

Air evacuation from the centrifuge chamber is upwardly into the second annular gap 56 and then downwardly into the first annular gap 54, whereafter evacuated air is channeled to the vacuum pump 36. As shown in FIG. 1, the motor 12 is also evacuated.

Returning to FIG. 2, the bars associated with each rotor model A–R are indicative of inertia. Each bar has a minimum inertia value that is the value when the rotor is free of specimen solution to be centrifugally separated into its components. A maximum inertia value represents the inertia when the rotor contains specimen solution to the maximum safe value set forth by the manufacturer.

In operation, a rotor 16 in FIG. 1 may have an inertia anywhere within the range between the minimum value and the maximum value indicated in FIG. 2. Thus, a computation of inertia as described in U.S. Pat. No. 4,827,197 to Giebeler may not allow the required identification. For example, if the computation of inertia provides a unit value of approximately 1.07, any one of six rotors of FIG. 2 may be designated, as indicated by line 58. Likewise, the technique of U.S. Pat. No. 5,235,864 to Rosselli et al., which teaches measuring resistance to motion at rotary speeds in which windage is dominant to inertia, may not be adequate. While the effect of windage increases exponentially with increases in speeds, inertia plays a significant role in determining the total resistance to accelerations even when the acceleration is from a first high speed to a higher speed.

Figure 3:
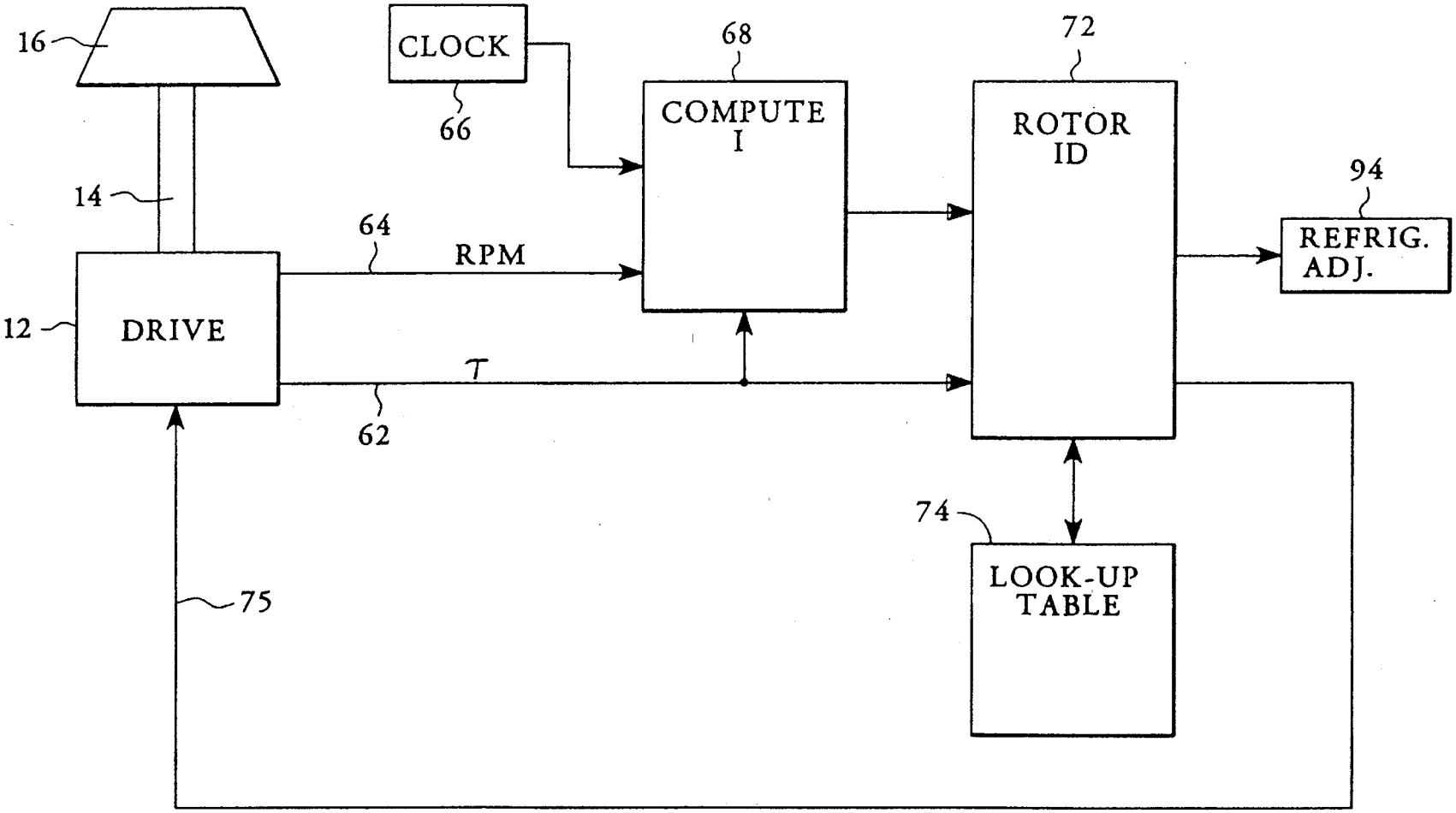
FIG. 3 is a schematic diagram of a first embodiment of a rotor identification system for use with the centrifuge of FIG. 1 in accordance with the invention.

The system of FIG. 3 provides an improved means for identifying a rotor as being one of a particular model. The rotor 16 is shown as being connected to the drive system 12 by the drive shaft 14. A determination of the moment of inertia should account for the contribution of the inertia by the shaft and the motor. Compensation for the contributions of the shaft and motor is easily accomplished, since these values are fixed. Optionally, the contributions of the shaft and the motor may be disregarded, since the contributions are insignificant as compared to the moment of inertia of the rotating rotor 16.

As previously noted, the drive system preferably uses a switched reluctance motor 12. Switched reluctance drives provide precise torque data that are available in real time on a continuous basis from drive control electronics. Line 62 is shown to provide an output indicative of torque of the drive motor. Furthermore, a switched reluctance drive has a continuously operating armature-position indicator which is required for proper operation of the motor. The frequency of pulses from the armature-position indicator may be used to determine the rotational speed of the rotor 16. RPM line 64 represents an input to inertia computation circuitry 68, enabling the circuitry to determine the speed of the rotor. A clock 66 also provides an input to the circuitry 68.

Inertia is computed in a first step. Either the time period ($\Delta t$) necessary for acceleration from a first selected rotational speed to a second selected speed ($\Delta\omega$) is measured, or the change in speed ($\Delta\omega$) within a fixed period ($\Delta t$) of acceleration is measured. Angular acceleration can then be determined by dividing $\Delta t$ into $\Delta\omega$. Torque data from line 62 is then utilized by the inertia computation circuitry 68. The moment of inertia in driving the rotor 16 is equal to torque divided by the value of acceleration determined utilizing data from RPM line 64 and clock input.

Following the computation of the moment of inertia, a first selection among the rotors of FIG. 2 can be performed. For example, if the rotor inertia is determined to be the value represented by line 58, rotor 16 must be one of the six rotors intersected by line 58. Thus, the other twelve rotor models of FIG. 2 are disqualified as being a possible rotor model into which rotor 16 can be classified.

A second sorting step utilizes a measurement of windage of the rotor 16. The most applicable windage power equation for centrifuge rotors running in smooth enclosures is one in which windage varies as the rotational speed cubed, the rotor diameter to the fifth power and the length slightly less than directly. It is well known, and logical, that close fitting symmetrical enclosures reduce windage because there is less loss of velocity as the air circulates back to the rotor. Since small rotors are further away from chamber walls, they more closely approach an "pen air" condition than larger rotors within the same centrifuge.

The computation of inertia at circuitry 68 is performed at relatively low speeds in which windage is negligible, and practically nonexistent. The first selected speed from which the rotor 16 is accelerated may be 0 rpm. However, the measurement of windage power is performed at relatively high speeds. Each of the eighteen rotor models of FIG. 2 has a rated maximum safe speed. Following the sorting process allowed by the computation of inertia, the rotor 16 may be accelerated to the lowest of the rated maximum safe speeds of the rotor models that have not been disqualified. Again, using the example of a measurement indicated by line 58 in FIG. 2, the rotor can be accelerated to the lowest of the six maximum safe speeds of the subset of rotors D–I.

With the rotor 16 maintained at a constant high speed, the torque generated by drive system 12 will be, after a minor adjustment for motor losses, equal to the rotor windage power. In FIG. 3, rotor identification circuitry 72 has an input from torque line 62. Once the speed of the rotor is fixed, the rotor identification circuit can utilize data from line 62 to address a look-up table 74 containing the expected windage values at that constant speed. In this manner, the possible rotor models into which rotor 16 can be classified is further limited. Ideally, one of the six rotor models D–I of FIG. 2 is pinpointed.

If more than one rotor model remain as a possibility, the sorting based upon windage can be repeated at a higher rotational speed of the rotor 16. However, repeating this windage-dependent sorting step still requires that the lowest of the rated maximum safe speeds of possible rotor models in the subset of models is not exceeded. Therefore, repeating this sorting is possible only if the initial windage-depending sorting disqualified the rotor model that previously was the rotor model having the lowest rated maximum safe speed.

In addition to storing data related to expected windage values, the memory of look-up table 74 stores expected inertia values. Thus, the inertia computation circuitry 68 has an input to the rotor identification circuitry 72. Moreover, table 74 includes memory for associating heat generation with changes in windage. Each of the eighteen rotor models may have a unique windage-heat characterization. More likely, the eighteen rotor models will be classified in families, e.g. swinging bucket rotors, fixed angle rotors, continuous flow rotors and special rotors. The memory of look-up table 74 may be utilized by circuitry 72 to provide data to a refrigeration adjustment circuit 94. For example, by monitoring torque line 62, it is possible to detect times in which heat generated by windage changes sufficiently to require adjustments to a refrigeration system. The desired temperature for a particular centrifuge run will depend upon a number of factors, including the type of sample under analysis. Typically, the desired temperature is selected before the centrifuge run is initiated, and may be entered by an operator. Consequently, the rotor identification circuitry 72 may be used to first identify the rotor in use and to then control the refrigeration system at circuit 94 by utilizing that data stored in table 74 that are related to the identified rotor. The control may be dynamic, so that the refrigeration system is affected with each significant change in windage, as for example by a change in rotational speed or a change in vacuum level.

In a more simplified form, the refrigeration adjustments to circuit 94 are settings of temperature compensation values. Often, the temperature monitoring device, such as a thermistor, of a centrifuge is at the bottom of the enclosed chamber in which the rotor is spun. The temperature at the bottom of the chamber typically will be less than the temperature at the rotor. The difference in temperatures will vary, depending upon the rotor in use. Consequently, rotors may be assigned temperature compensation values that allow the centrifuge to more accurately determine the temperature at the rotor. In FIG. 3, the rotor may be identified at circuitry 72, whereafter the temperature compensation value for the identified rotor may be obtained from table 74 and used to set the refrigeration adjustment circuit 94.

The circuit of FIG. 3 is used to identify the rotor 16 for providing refrigeration control and for ensuring that the rotor is not accelerated beyond a rated maximum safe speed. Line 75 provides an input to the drive system 12 as the circuitry 72 is used to identify the rotor 16.

Figure 4:
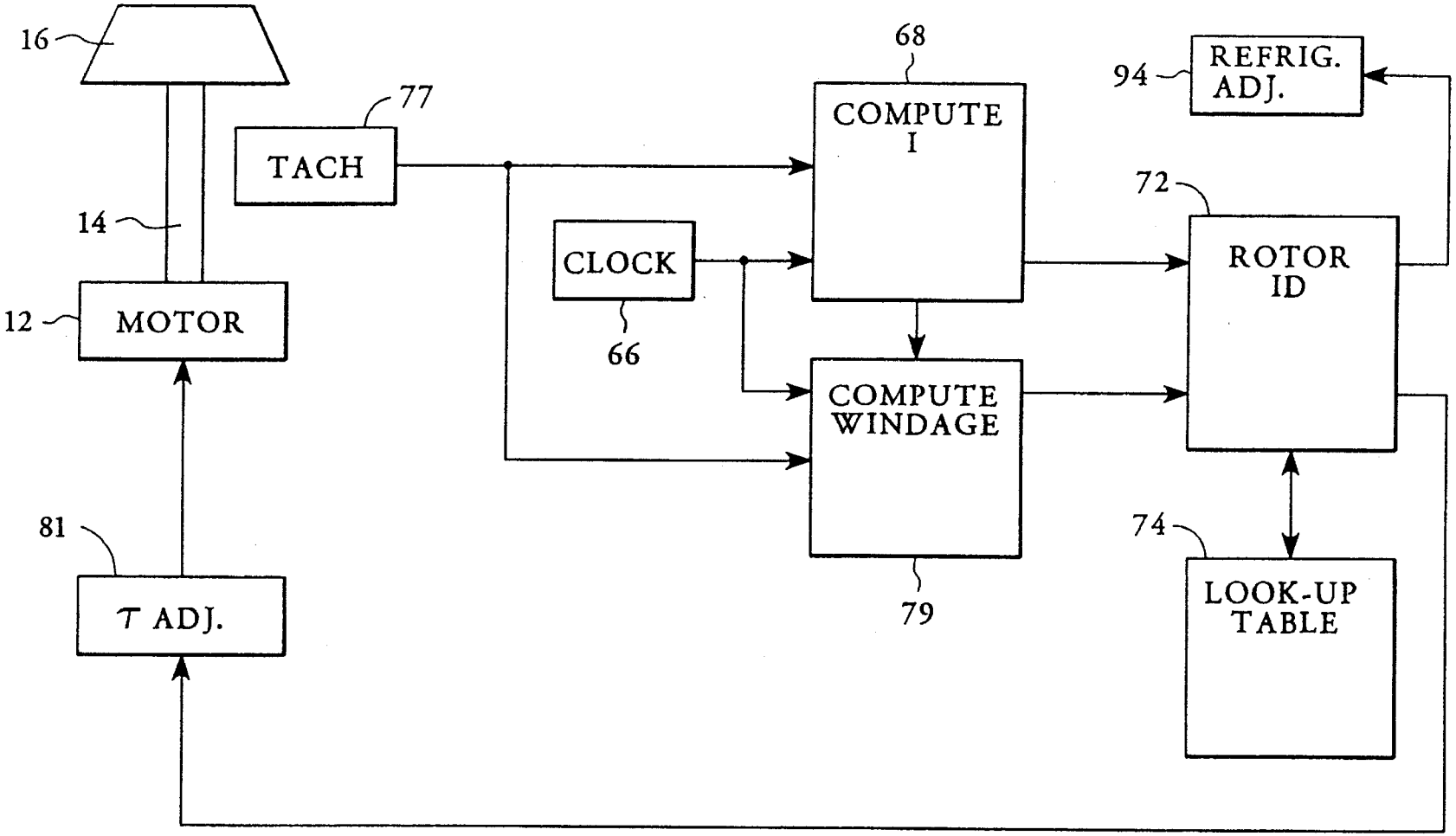
FIG. 4 is a schematic diagram of a second embodiment of a rotor identification system for use with the centrifuge of FIG. 1 in accordance with the invention.
Figure 5:
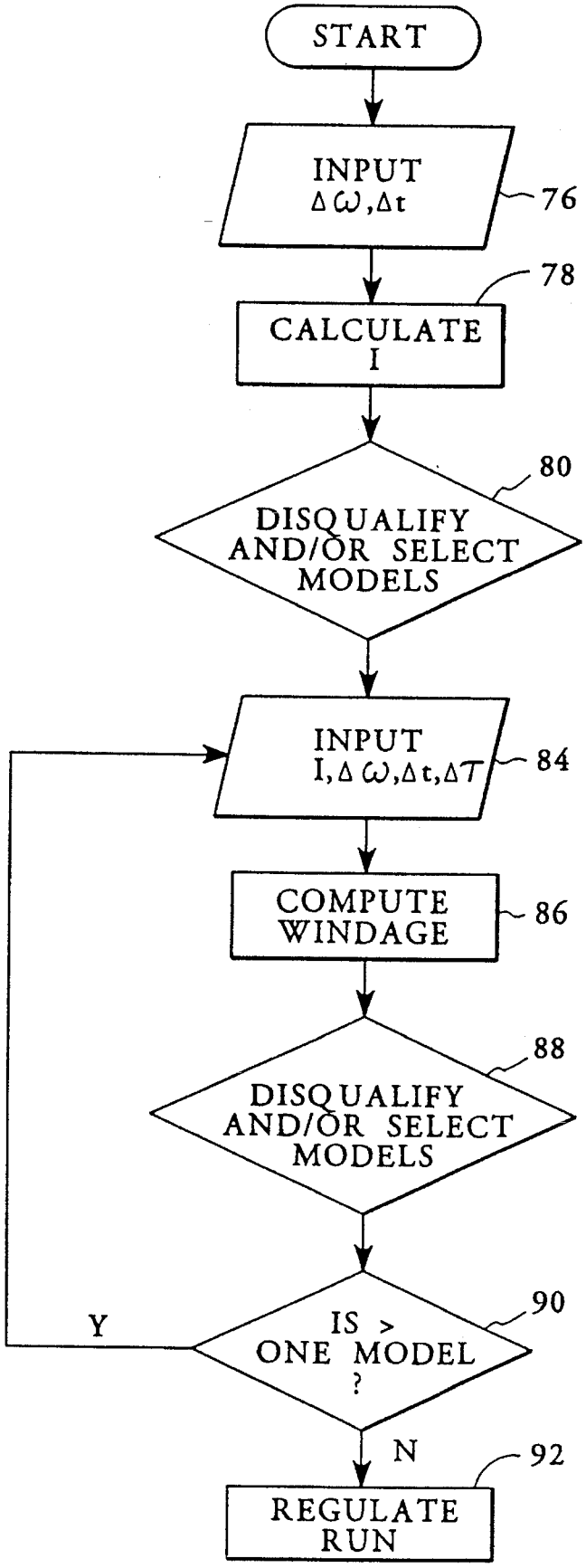
FIG. 5 is a flow chart of the rotor identification method of FIG. 4.

FIGS. 4 and 5 refer to a second embodiment for identifying the rotor 16. In this embodiment, the motor 12 is not a switched reluctance motor, so that torque data is not directly obtained from the drive system. While other types of motors may be adapted to provide the torque data required for FIG. 3, FIG. 4 illustrates a system in which computation occurs independently of the drive system.

The elements of FIG. 4 that are functionally identical to elements in FIG. 3 are provided with the same reference numerals. The angular velocity of rotor 16 can be determined using a tachometer 77. Tachometers and equivalent devices are conventionally used in centrifuges. Also shown in FIG. 4 is the clock 66 used during the measured acceleration of the rotor. Both the tachometer and the clock have outputs connected to circuitry 68 for computing inertia and circuitry 79 for computing windage power. The circuitry 68 and 79 and rotor identification circuitry 72 may be contained within a single central processing unit (CPU). A look-up table 74 may be ROM memory. The look-up table includes data regarding the minimum inertia, the maximum inertia, the expected windage powers, as well as the rated maximum safe speed of each of the eighteen rotors of FIG. 2.

In the embodiment of FIGS. 4 and 5, inertia computation circuit 68 receives an input of $\Delta\omega$ and $\Delta t$ of the first measured acceleration of the rotor 16. This input is shown as input 76 in FIG. 5. For a constant torque, an indication of moment of inertia can be calculated at 78. While not critical, the indication of moment of inertia is preferably obtained at the same value of constant torque for each run, so that this value can be used at inertia computation circuitry 68 without requiring a torque readout from the motor 12. Since the quantity of specimen within the rotor 16 is unknown, the calculated moment of inertia is only an indication of the moment of inertia of the rotor. In the example set forth above, an indication of 1.07 could be expected for any of the six rotor models intersected by line 58. The rotor ID circuit 72 addresses the look-up table 74 to disqualify the other twelve rotor models and/or select the six possible rotors. The step of reducing the possible rotor models to which rotor 16 can identify is shown at 80 in FIG. 5. Thus, a subset of possible rotors is established.

Based upon the lowest rated maximum safe speed of the remaining possible rotor models, a second measured acceleration of the rotor 16 takes place. Again, $\Delta\omega$ or $\Delta t$ may be fixed, and the other factor is measured, with the fixed factor preferably being $\Delta t$. The second measured acceleration should not exceed the lowest of the maximum safe speeds of the remaining possible rotor models, but should preferably reach that speed, since differences in windage are magnified with increases in speed. If torque is varied during the acceleration, the measure of change must also be input to 84 in FIG. 5. However, the torque is preferably fixed throughout the second measured acceleration, so that a Δ torque need not be entered into the calculation of windage.

An important aspect in determining windage power acting upon the accelerating rotor is the moment of inertia. The moment of inertia and the windage power act in concert to resist acceleration. While other factors that resist acceleration may be factored out, the moment of inertia cannot unless an input of the calculation of inertia is received. That is, factors such as friction of the bearing assembly of the motor 12 are known and fixed, but in the rotor identification method of the invention, the computation of inertia must be saved and input to the circuitry 79 for computing windage.

Windage power can be calculated by circuitry 72 and 79 according to the equation:

$$\text{windage power} = \text{torque input} - I\left(\frac{\Delta\omega}{\Delta t}\right).$$

The value of I (Δω/Δt) is inertial drag. In FIG. 4, there is no input to circuitry 79 for torque, since the computation of windage is preferably performed with the fixed value being the same each time. If the torque value will be different for different windage computations, a torque input to circuitry 79 will be necessary. The computation of windage is shown as step 86 in FIG. 5.

The diameter of a rotor is the dominant factor with respect to the windage power developed by rotating rotors of the same family. Consequently, the rotor ID circuit 72 is able to disqualify some of the six rotors in the subset of rotor models intersected by line 58 in FIG. 2. The disqualification at step 88 in FIG. 5 may be a positive selection of at least one rotor model, thereby disqualifying other rotor models. A decision is then made at step 90 regarding the number of remaining possible rotor models. If only one model remains in the process of elimination provided by steps 80 and 88, the identification of the rotor is used to regulate run parameters at 92. For example, the current to the drive motor 12 may be increased by adjustment at element 81 in FIG. 4, so as to accelerate the rotor 16 to the rated maximum safe speed of the identified rotor model. Moreover, refrigeration adjustment circuitry 94 may be activated to adjust centrifuge cooling in the same manner described with reference to FIG. 3. Offsets of refrigeration can be made in accordance with changes in windage. In a basic form, an input from the tachometer 77 to the refrigeration adjustment circuit 94 could be used to determine changes to windage power.

If the decision at step 90 in FIG. 5 yields an answer that more than one possible model remains after the disqualifications in steps 80 and 88, the rotor may be again accelerated and a third measured acceleration may be initiated. This third measured acceleration is an option when the second measured acceleration was to a speed that was only a fraction of the lowest of the maximum safe speeds or when the data of the second measured acceleration disqualified the rotor model that previously possessed the lowest maximum safe speed. The steps of calculating windage and disqualifying at least one of the remaining models are then repeated.

Windage power is computed at 86 for the third measured acceleration using the same technique as the computation during the second measured acceleration. Again, the moment of inertia must be taken into account in order to obtain an accurate indication of windage. Consequently, the third measured acceleration allows a computation which may be used to further limit the number of rotor models to which the rotor in question can be identified. The method ideally repeats until only one possibility remains at step 90.

Optionally, two rotor models, which would be otherwise difficult to distinguish or indistinguishable using the approach described above, may be designed to have rotor lids that are sufficiently different with respect to windage-generation to allow resolution. Referring to FIG. 1, it is believed that a five percent increase in the diameter of the rotor lid 22 will increase windage by approximately twenty-five percent.

The calculation of the moment of inertia may optionally be carried out in an evacuated chamber of the centrifuge 10. On the other hand, the computation of windage power cannot be performed for an acceleration of a rotor 16 within a fully evacuated chamber. The atmosphere within the chamber will directly influence the development of windage power on a spinning rotor. Therefore, the computation of windage preferably includes an offset related to the absolute pressure in the chamber.

During a centrifugal separation of sample within the specimen containers 18 and 20, temperature control in a less than fully evacuated chamber of the centrifuge 10 is difficult. Much of the work of the drive system 12 is performed in order to circulate the mass of air as the rotor is rotated. For a particular rotor, the windage power required varies directly with the cube of the rotational speed. Many centrifuge systems include a temperature set for a calibration speed. It is difficult, at best, to provide a temperature offset correction for rotational speeds far removed from the calibration speed. Because the windage power is exponentially increased with increases in diameter of a rotor, it becomes even more difficult to provide a temperature offset that is applicable to all rotor models at all speeds. It is known to provide manually set offset values based upon experimental measurements of each rotor at the rated maximum safe speed of the rotor.

The system and method of FIGS. 3, 4 and 5 provide a more efficient temperature offset adjustment scheme. After the rotor is identified at the identification circuit 72, refrigeration adjustment at 94 can be performed utilizing look-up tables 74 in the ROM. Information contained in the look-up table is combined with realtime information regarding the windage power to control the refrigeration system.

The automatic adjustment of temperature can be used to replace manual settings of temperature offsets. Moreover, it is possible to use the technique as an automatic compensation for high altitude operation, since windage power is affected by changes in altitude. In a simplification of FIGS. 3–5, temperature control can be performed without calculating the moment of inertia. For example, in some applications, the indication of windage as provided by monitoring motor torque at a constant speed in the embodiment of FIG. 3 may be used first to identify the rotor and then to adjust refrigeration with significant changes in windage.

What is claimed is:

1. A method of identifying a rotor as being at least one of a plurality of models, said method comprising the steps of:

generating an indication of moment of inertia of said rotor, including accelerating said rotor for a first measured increase in rotational speed;

in response to said indication of moment of inertia, limiting the possible models to which said rotor can be identified to a first subset of said plurality of models;

while taking into account said indication of moment of inertia of said rotor, calculating an indication of windage in rotating said rotor at an accelerated rotational speed greater than speeds associated with said first measured increase; and in response to said indication of windage, selecting at least one model from said first subset to which said indications of moment of inertia and windage are characteristic, defining a second subset of models of said plurality of models with said second subset including less models than said first subset.

2. The method of claim 1 further comprising, where said step of selecting provides more than one model, further accelerating said rotor and determining a second indication of windage, said method further comprising selecting a model of said more than one model based upon said second indication of windage.

3. The method of claim 2 further comprising repeating said accelerating, determining and selecting steps to obtain a single indication of windage uniquely associated with a particular model, and operating a refrigeration system coupled to cool said rotor based upon selection of said particular model within said plurality of models.

4. The method of claim 1 wherein said calculating an indication of windage includes accelerating said rotor for a second measured increase in rotational speed.

5. The method of claim 1 wherein said calculating an indication of windage includes maintaining said rotor at a fixed speed and generating a signal representative of torque input of a drive system for rotating said rotor.

6. A centrifuge system comprising:

drive means for rotatably supporting any one of a plurality of rotor models;

first means for measuring inertia of a rotor supported by said drive means;

first decision means, responsive to said first means, for reducing possible rotor models to which said supported rotor can be identified based upon known inertial values of said plurality of rotor models, defining a first subset of said plurality of rotor models;

second means, responsive to said drive means and said first means, for measuring windage of said supported rotor; and second decision means, responsive to said second means, for reducing possible rotor models to which said supported rotor can be identified based upon known windage values of said plurality of rotor models, defining a second subset of a plurality of rotor models, with said second subset including less models than said first subset.

7. The system of claim 6 further comprising memory means for storing said known windage values and said known inertial values and further for storing a rated maximum safe rotational speed for each of said plurality of rotor models, said memory means being in electrical communication with said first and second decision means.

8. The system of claim 7 further comprising means, responsive to said second decision means, for limiting rotational speed of said supported rotor to a rated maximum safe speed for the rotor model to which said supported rotor can be identified.

9. The system of claim 6 further comprising a refrigeration system in thermal energy transfer engagement with a chamber housing for enclosing said supported rotor, and further comprising means for dynamically controlling said refrigeration system in response to changes in rotational speed of said supported rotor.

10. The system of claim 9 further comprising means for monitoring rotational speed of said supported rotor, said means for dynamically controlling being responsive to said means for monitoring.

11. A method of operating a refrigeration control system of a centrifuge comprising:

rotating a centrifuge rotor within a chamber;

while said centrifuge rotor is rotating, generating a signal indicative of windage associated with said rotating;

based upon said signal indicative of windage, identifying said centrifuge rotor as being one of a particular rotor model within a plurality of models; and refrigerating said chamber based upon known refrigeration data related to said particular rotor model.

12. The method of claim 11 wherein said generating said signal indicative of windage includes isolating losses attributable to work of circulating gas within said chamber from losses attributable to inertia of said centrifuge rotor.

13. The method of claim 11 wherein said generating said signal includes monitoring input of torque required for rotating said centrifuge rotor.

14. The method of claim 13 wherein said monitoring input of torque includes maintaining rotation of said centrifuge rotor at a constant high rotational speed, and wherein generating said signal indicative of windage is a measure of drive torque required to maintain said high rotational speed.

15. The method of claim 13 wherein said generating said signal further includes performing a timed acceleration of said centrifuge rotor and determining windage based upon torque required to achieve said timed acceleration.

16. The method of claim 15 wherein said generating said signal further includes determining the moment of inertia of said centrifuge rotor, said determining said moment of inertia including accelerating said centrifuge rotor for a period preceding said timed acceleration.

17. The method of claim 11 further comprising monitoring changes to rotation of said centrifuge rotor and adjusting said refrigerating of said chamber based upon said changes to rotation, including generating a signal indicative of one of rotational speed and torque utilized to rotate said centrifuge rotor.

* * * * *